US005729819A

United States Patent [19]

Maekawa et al.

[11] Patent Number: 5,729,819

[45] Date of Patent: Mar. 17, 1998

[54] IMAGE FORMING APPARATUS

[75] Inventors: Kazunobu Maekawa; Kuniaki Ishiguro, both of Toyokawa, Japan

[73] Assignee: Minolta Co., Ltd., Osaka, Japan

[21] Appl. No.: 748,403

[22] Filed: Nov. 13, 1996

[30] Foreign Application Priority Data

Nov. 13, 1995 [JP] Japan ..... 7-294309

[51] Int. Cl.[6] ..... G03G 21/00

[52] U.S. Cl. ..... 399/401; 399/303; 399/364

[58] Field of Search ..... 399/303, 304, 399/305, 66, 364, 401, 411

[56] References Cited

U.S. PATENT DOCUMENTS 5,132,739 7/1992 Mauer et al. .
5,220,387 6/1993 Tsunoda et al. .
5,250,994 10/1993 Ito et al. .
5,280,325 1/1994 Yamada et al. .
5,402,218 3/1995 Miyashiro et al. .
5,606,407 2/1997 Suzuki ..... 399/303

FOREIGN PATENT DOCUMENTS 6-286899 10/1994 Japan .

*Primary Examiner*—R. L. Moses
*Attorney, Agent, or Firm*—Burns, Doane, Swecker & Mathis, LLP

[57] ABSTRACT

An image forming apparatus which performs image transfer on the rear side of a sheet by retransporting the sheet inverted via inverting section to a transfer drum in duplex copy mode. After an image has been transferred onto a rear surface of the sheet, the transfer drum is separated from an image bearing member, thereby separation agent, which is adhered to the transfer drum due to refeeding of the sheet that has once passed through fixing unit, is removed from the transfer drum without adhering to the image bearing member.

9 Claims, 10 Drawing Sheets

IMAGE FORMING APPARATUS

BACKGROUND OF THE INVENTION

1. Field of the Invention

The present invention relates to an image forming apparatus for color copying apparatuses and the like, and particularly relates to an image forming apparatus capable of forming images on both sides of a copy sheet.

2. Description of the Related Art

Heretofore, image forming apparatuses have been proposed which support a transfer sheet on a transfer sheet supporting member so as to transfer an image to a surface of said transfer sheet and, after said image transfer, separate the transfer sheet from the transfer sheet supporting member, fix the transferred image on the transfer sheet, and subsequently invert the transfer sheet and again hold said transfer sheet on the transfer sheet supporting member so as to transfer an image to the back side of said transfer sheet (e.g., refer to Japanese Unexamined Patent Application No. HEI 6-286899).

In the fixing unit, a separation agent such as, for example, silicone oil or the like is typically supplied to the fixing roller so as to prevent toner image offset onto the fixing roller. Therefore, silicone oil becomes attached to the surface of the transfer sheet that has once passed through the fixing unit. Since a transfer sheet must be supported on the transfer sheet supporting member to copy to the back side of said sheet in the aforesaid image forming apparatus capable of duplex copying, the surface of the transfer sheet to which silicone oil is adhered comes into contact with the transfer sheet supporting member, thereby transferring the silicone oil to the surface of the transfer sheet supporting member. Ultimately, the silicone oil which adheres to the transfer sheet supporting member will adhere to the image-bearing member, and cause toner physically adhering to the image-bearing member so as to produce inadequate cleaning, irregular charging, and nonuniform image transfer which result in image defects.

In order to eliminate the aforesaid disadvantage, the previously mentioned application proposed eliminating the silicone oil adhered to the surface of the transfer sheet while in the inversion transport path before the transfer sheet which has passed through the fixing unit is again held on the transfer sheet supporting member.

However, in the apparatus disclosed in the previously mentioned application, the silicone oil adhered to the transfer sheet cannot be completely and reliably removed, such that residual oil adheres to the image-bearing member and causes the aforesaid disadvantages.

When the friction coefficient is increased between the transfer sheet and an oil absorption roller and the rotational speed of the oil absorption roller is increased so as to reliably eliminate the silicone oil adhering to the transfer sheet, there is concern that the transfer sheet may be damaged.

U.S. Pat. No. 5,402,218 discloses an apparatus which separates the transfer sheet supporting member from the image-bearing member when paper jams occur.

However, this patent does not disclose the timing for automatic separation of the transfer sheet supporting member and the image-bearing member, such that the problem of oil adhered to the surface of the transfer sheet supporting member being transferred to the image-bearing member remains unresolved.

OBJECTS AND SUMMARY

A main object of the present invention is to prevent the occurrence of inadequate cleaning, irregular charging, and nonuniform image transfer.

Another object of the present invention is to provide an image forming apparatus capable of reliably preventing the adherence of oil on an image-bearing member.

Still another object of the present invention is to provide an image forming apparatus capable of preventing the adherence of oil on an image-bearing member without damaging the transfer sheet.

These and other objects of the present invention are accomplished by an image forming apparatus comprising an image bearing member, a transfer sheet supporting member which supports a transfer sheet thereon so as to transfer an image to a surface of the transfer sheet by driving the transfer sheet supporting member in contact with the image bearing member, separating means for separating the transfer sheet from the transfer sheet supporting member, a fixing device for fixing an image formed on the transfer sheet separated from the transfer sheet supporting member, a supply member for supplying a separation agent to the fixing device, inverting means for inverting and retransporting the transfer sheet fixed toner image thereon to said transfer sheet supporting member, a mechanism for making said image bearing member and said transfer sheet supporting member contact with or separate from each other, and control means for controlling said mechanism to separate the transfer sheet supporting member from the image bearing member after an image has been transferred onto a rear surface of the transfer paper retransported by said inverting means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
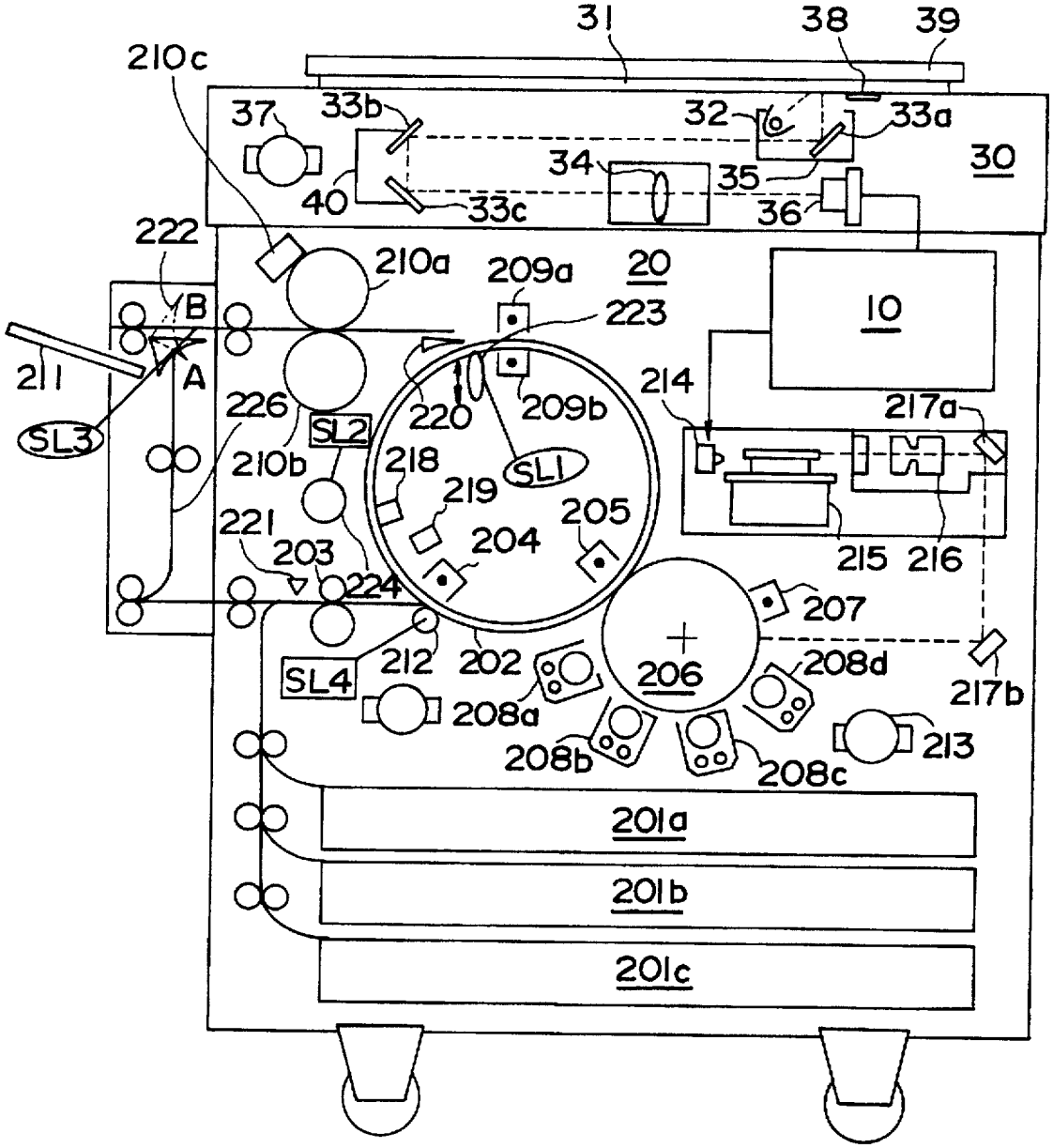
FIG. 1 is a section view of the center section of the apparatus of the present invention.

The preferred embodiments of the present invention are described hereinafter with reference to the accompanying drawings. FIG. 1 shows the overall construction of a digital full color copying apparatus.

The digital full color copying apparatus reads an original document via an image scanner 30, and accomplishes signal processing of the read image via a digital signal processing unit 10. A printing unit 20 prints an image corresponding to the original document image read by image scanner 30 as a full color image on a copy sheet.

In image scanner 30, an original document placed on a glass document table 31 is covered by a cover plate 39, but this may be replaced when an automatic document feeder (not shown in the drawing) is installed. The document placed on glass document table 31 is illuminated by lamp 32, and the light reflected therefrom is directed by mirrors 33*a*, 33*b*, and 33*c* and forms an image via lens 34 on a linear full color sensor (hereinafter referred to as "CCD sensor"), which converts the electrical signals to full color information red (R), green (G), and blue (B) components, and transmits said R, G, B data to signal processing unit 10. A first slider 35 is moved at speed V, and a second slider 40 mechanically moved in a direction perpendicular to the electrical scanning direction of CCD 36 at a speed of V/2 so as to scan the entire document surface. A white panel 38 used for shading correction is provided at the edge of the glass document table 31. Signal processing unit 10 electrically processes the signal produced by the aforesaid reading, and breaks down said signals into magenta (M), cyan (C), yellow (Y), and black (Bk) components, which are then transmitted to printing unit 20. One component among the C, M, Y, and Bk components is sequentially transmitted to the printing unit 20 in accordance with the a single document scan by image scanner 30, such that a single printout is completed by a total of four scans (sequential area transfer method).

The C, M, Y, Bk image signal transferred by image processing unit 10 modulate the semiconductor laser 214 in accordance with the image signal level via a laser diode driver (hereinafter referred to as "PHC driver"). A laser beam scans the surface of a photosensitive drum 206 via polygonal mirror 215, f-θ lens 216, and bending mirrors 217*a* and 217*b*.

The developing unit comprises C, M, Y, and Bk developing devices 208*a*, 208*b*, 208*c*, and 208*d*, respectively; developing devices 208*a*, 208*b*, 208*c*, and 208*d* develop an electrostatic latent image formed on the surface of photosensitive drum 206 via toner. On the other hand, a copy sheet supplied from either paper supply units 201*a*, 201*b*, or 201*c* is wrapped around a transfer drum 202 via adsorption charger 204, and transported to a transfer position via timing roller 203, whereupon the developed image formed on photosensitive drum 206 is transferred onto said copy sheet via a transfer charger 205. Then, adsorption charger 212 moves into positions of contact and retraction relative to transfer drum 202 via the ON/OFF switching of a solenoid SL4.

Thus, after the four colors C, M, Y, and Bk are sequentially transferred, the copy sheet is separated from the transfer drum via separation chargers 209*a* and 209*b*, lifting member 223, and separation finger 220, transported between fixing rollers 210*a* and 210*b*, and is ejected to discharge tray 211. Lifting member 223 is closed and released via ON/OFF switching of a solenoid SL1. A supply member 210*c* made by felt or the like is in contact with fixing roller 210*a* so as to supply a separation agent such as silicone oil or the like onto the surface of fixing roller 210*a*, thereby to prevent toner image offset onto fixing roller 210*a*.

Oil adhering to the surface of transfer drum 202 from which the copy sheet has separated is removed therefrom by oil removing roller 224. Oil removing roller 224 contacts and retracts from transfer drum 202 via the ON/OFF switching of a solenoid SL2. Reference numbers 218 and 219 refer to reference position sensors for the transfer drum, and the head of the copy sheet is adhered to this position.

In duplex copy mode, after fixing, the copy sheet is transported to an inversion transport path 226 via a switching finger 222, said sheet is inverted front to back, and the copy sheet is again fed to transfer drum 202. Reference number 221 refers to a sensor for detecting the leading edge of a copy sheet; a copy sheet is detected when it arrives at timing roller 203.

Figure 2:
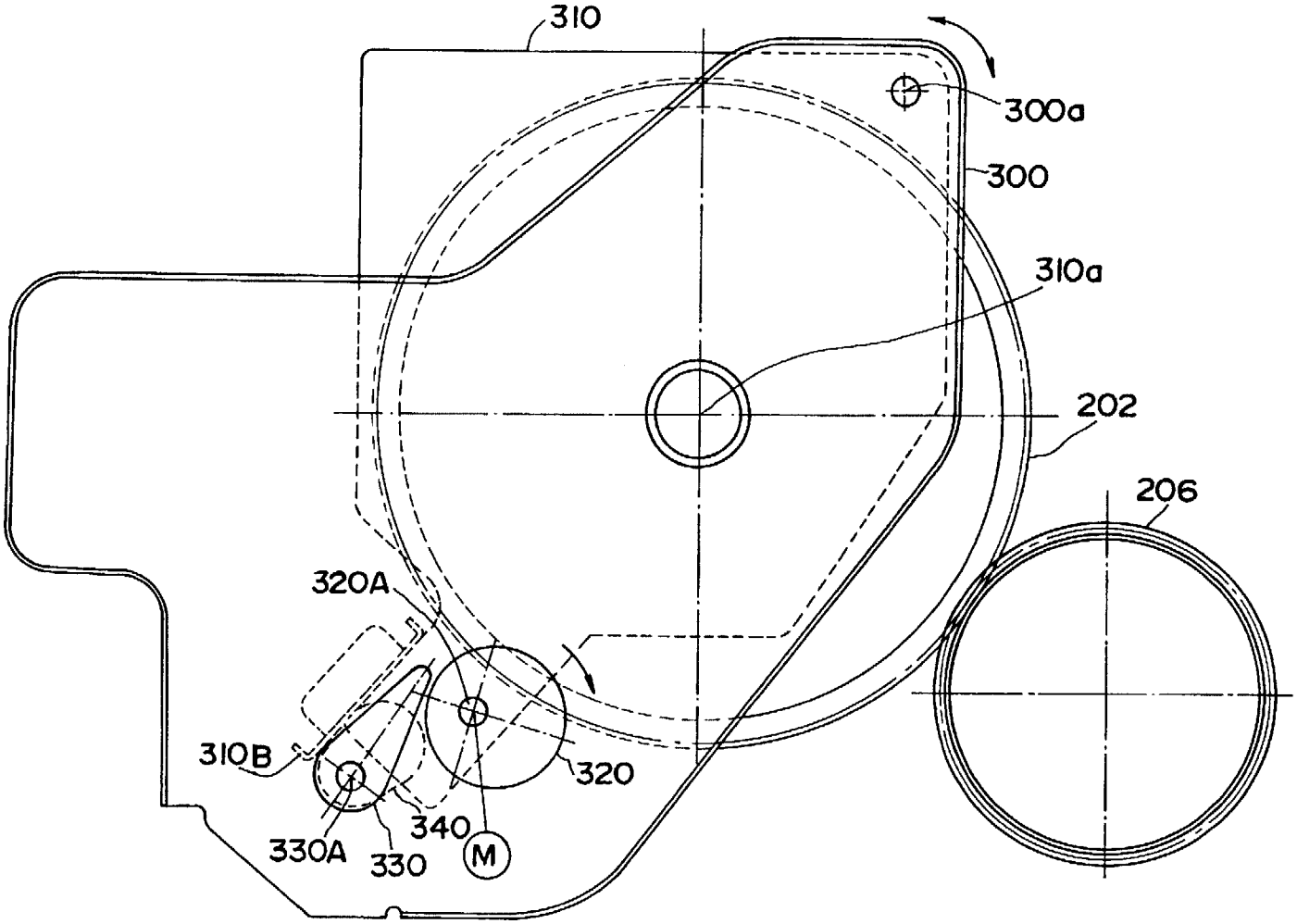
FIG. 2 is a structural view briefly showing the essential part of the transfer drum drive mechanism of the present invention.
Figure 3:
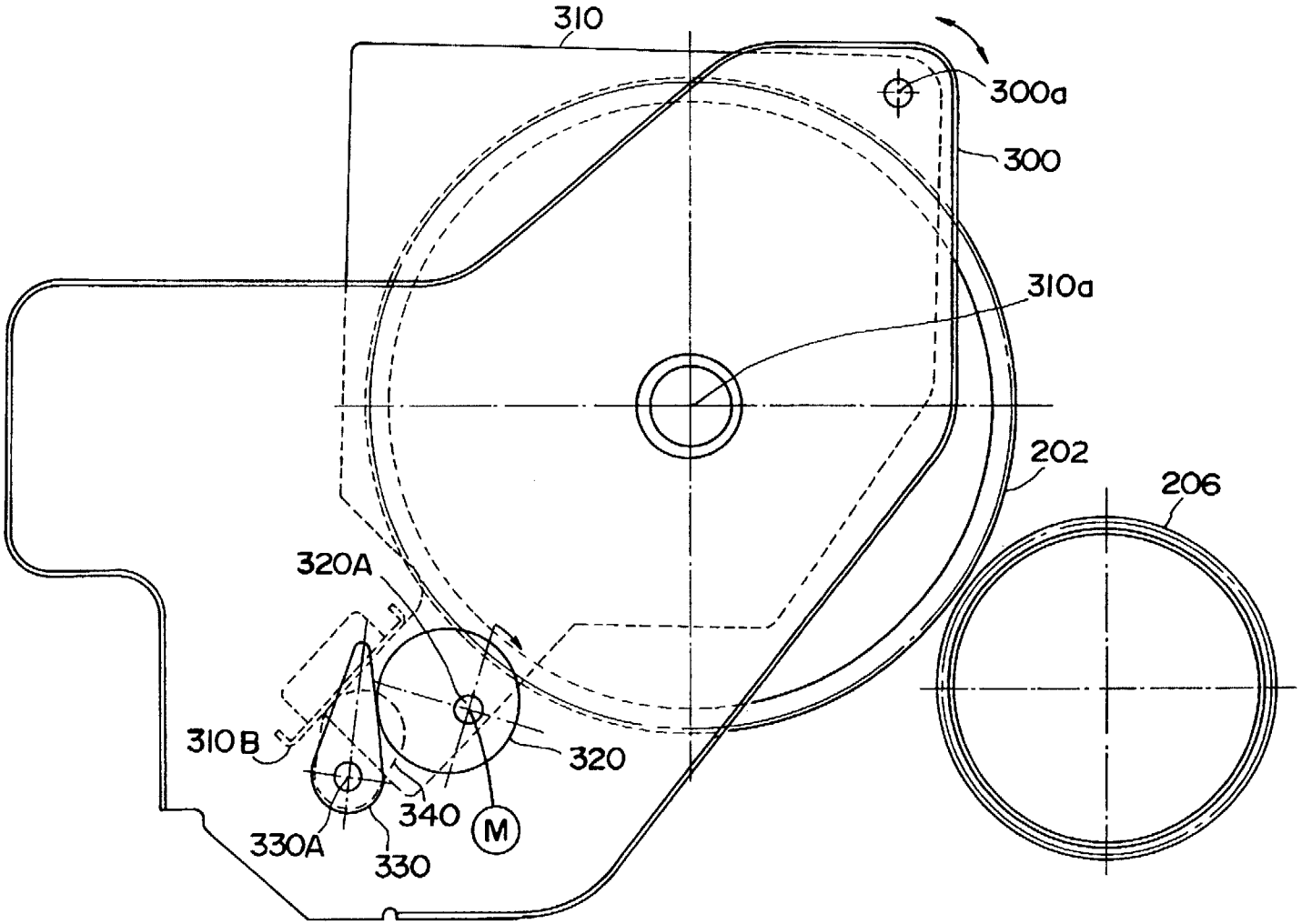
FIG. 3 is a structural view briefly showing the essential part of the transfer drum drive mechanism of the present invention.

FIGS. 2 and 3 show the mechanism for achieving contact and separation of the transfer drum 202 relative to photosensitive drum 206. FIG. 2 shows both drums in the contact state, and FIG. 3 shows both drums in the separated state.

In FIG. 2, transfer drum 202 is supported on the shaft 310*a* of oscillating member 310, which is oscillatable in the arrow direction about shaft 300*a*. The oscillation of oscillating member 310 is accomplished by rotating a lever 330 in a counterclockwise direction about a shaft 330A via half-rotation of a cam 320 in a clockwise direction. In this way, the lifting portion 340 provided on the same shaft as said shaft 330A is engaged, such that the oscillating tip 310B of oscillating member 310 is oscillated in a clockwise direction about shaft 300*a*. Thus, transfer drum 202 is separated from photosensitive drum 206, as shown in FIG. 3.

The contact between transfer drum 202 and photosensitive drum 206 is accomplished when cam 320 is again half-rotated, so as to release the contact between cam 320 and lever 330 and cause transfer drum 202 to rotate in a counterclockwise direction via its own weight, and come into contact with photosensitive drum 206, as shown in FIG. 2.

Cam 320 is supported on shaft 320A of transfer drum separation motor M2.

Figure 4:
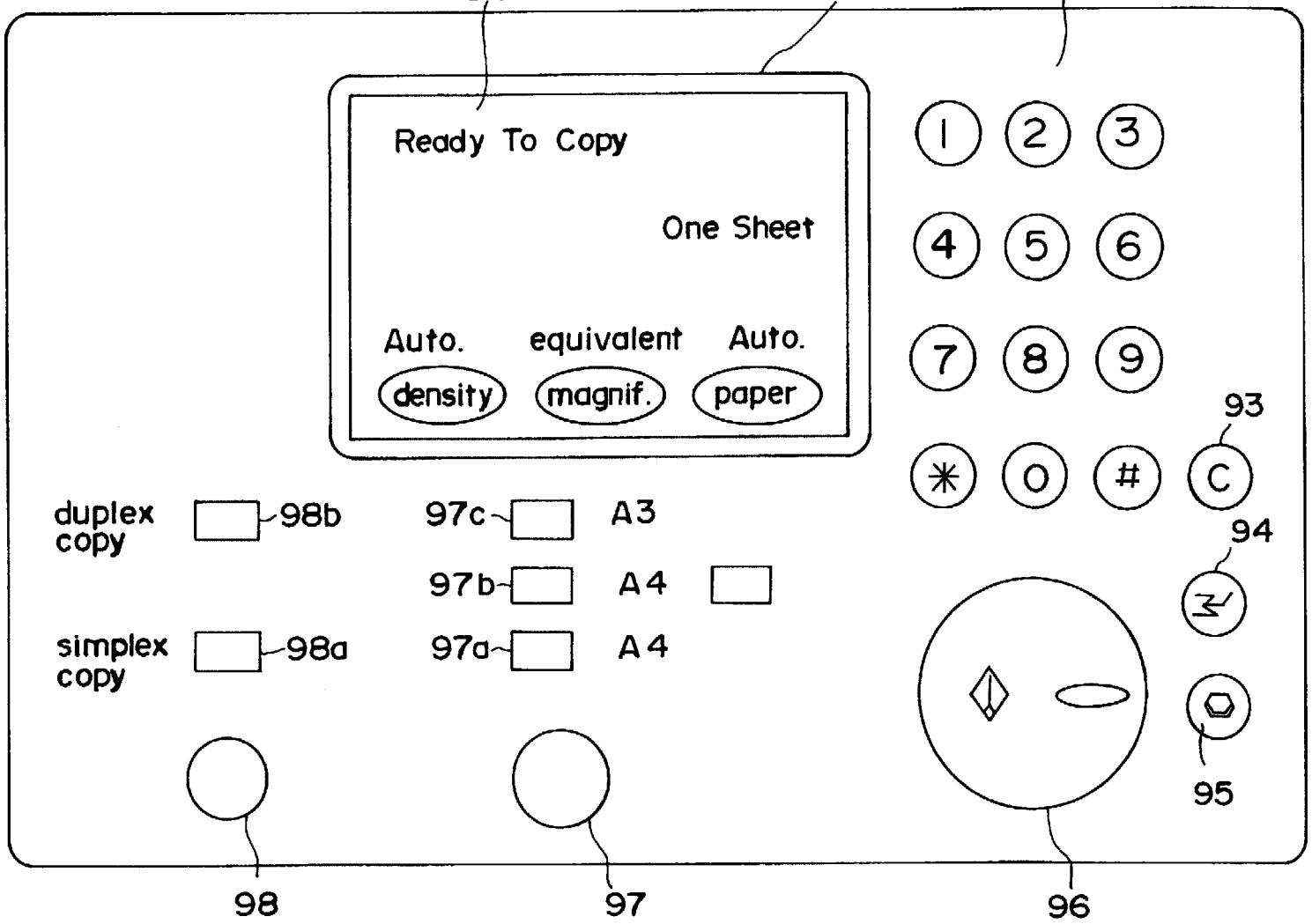
FIG. 4 is a drawing of the operation panel.

FIG. 4 is an exterior view of the operation panel.

Reference number 91 refers to a liquid crystal display, reference number 92 refers to a ten-key pad, reference number 93 refers to a clear key, reference number 94 refers to an interrupt key, reference number 95 refers to a stop key, reference number 96 refers to a copy start key, reference number 97 refers to a selection key for setting the paper size, reference numbers 97*a*, 97*b*, and 97*c* refer to light-emitting diode (LED) displays for displaying the respective selected paper sizes, reference number 98 refers to a copy mode key for switching between the duplex copy mode and simplex copy mode, reference numbers 98*a* and 98*b* refer to LED displays for displaying the set duplex and simplex copy modes.

Figure 5:
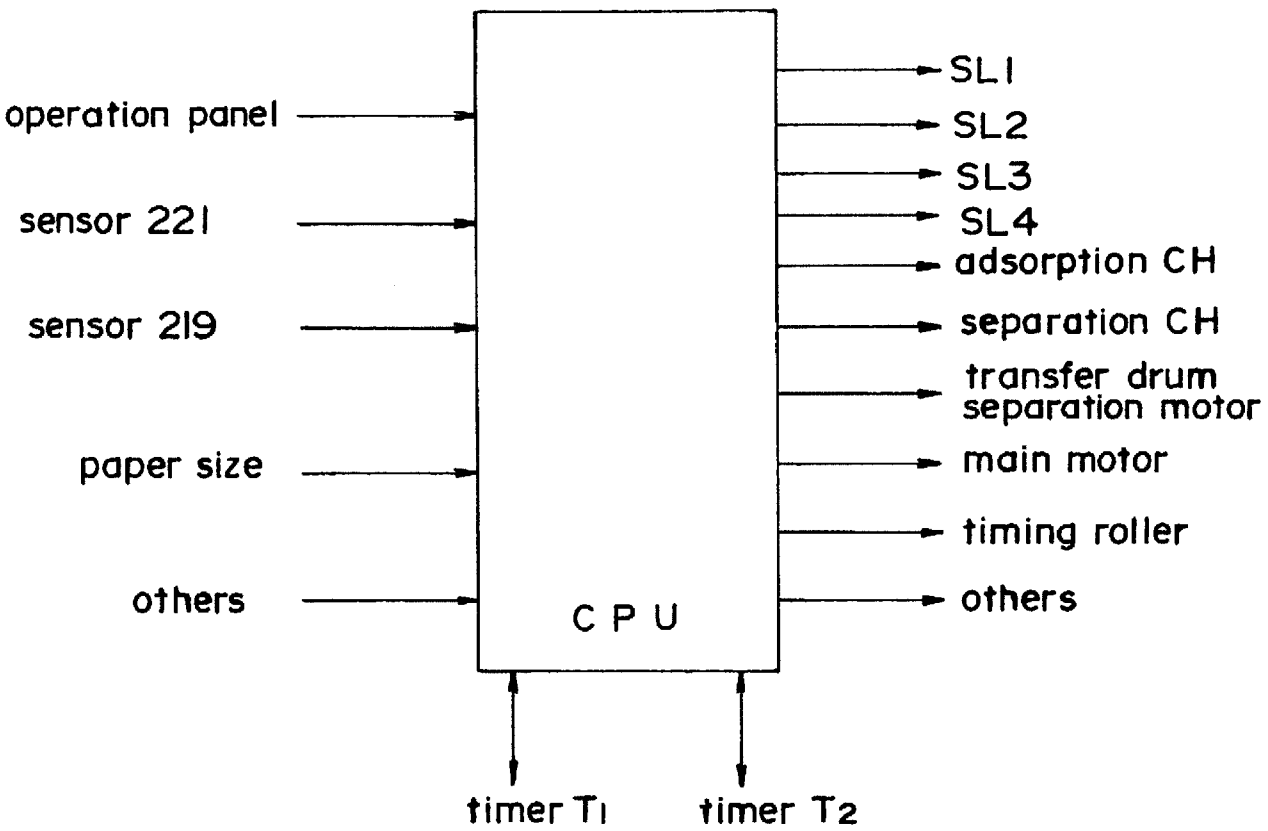
FIG. 5 is a block diagram of the control block of the present invention.

FIG. 5 is a block diagram of the control block.

Signals from the operation panel, and signals from sensor 221 and sensor 219, and paper size signals and other signals are input to a central processing unit (CPU). The CPU is connected to and transmits output to solenoid SL1, solenoid SL2, solenoid SL3, solenoid SL4, adsorption chargers, separation chargers, transfer drum separation motor, main motor, timing roller and the like.

FIGS. 6, 7, 8, and 9 are flow charts showing the processing of the control block.

Figure 6:
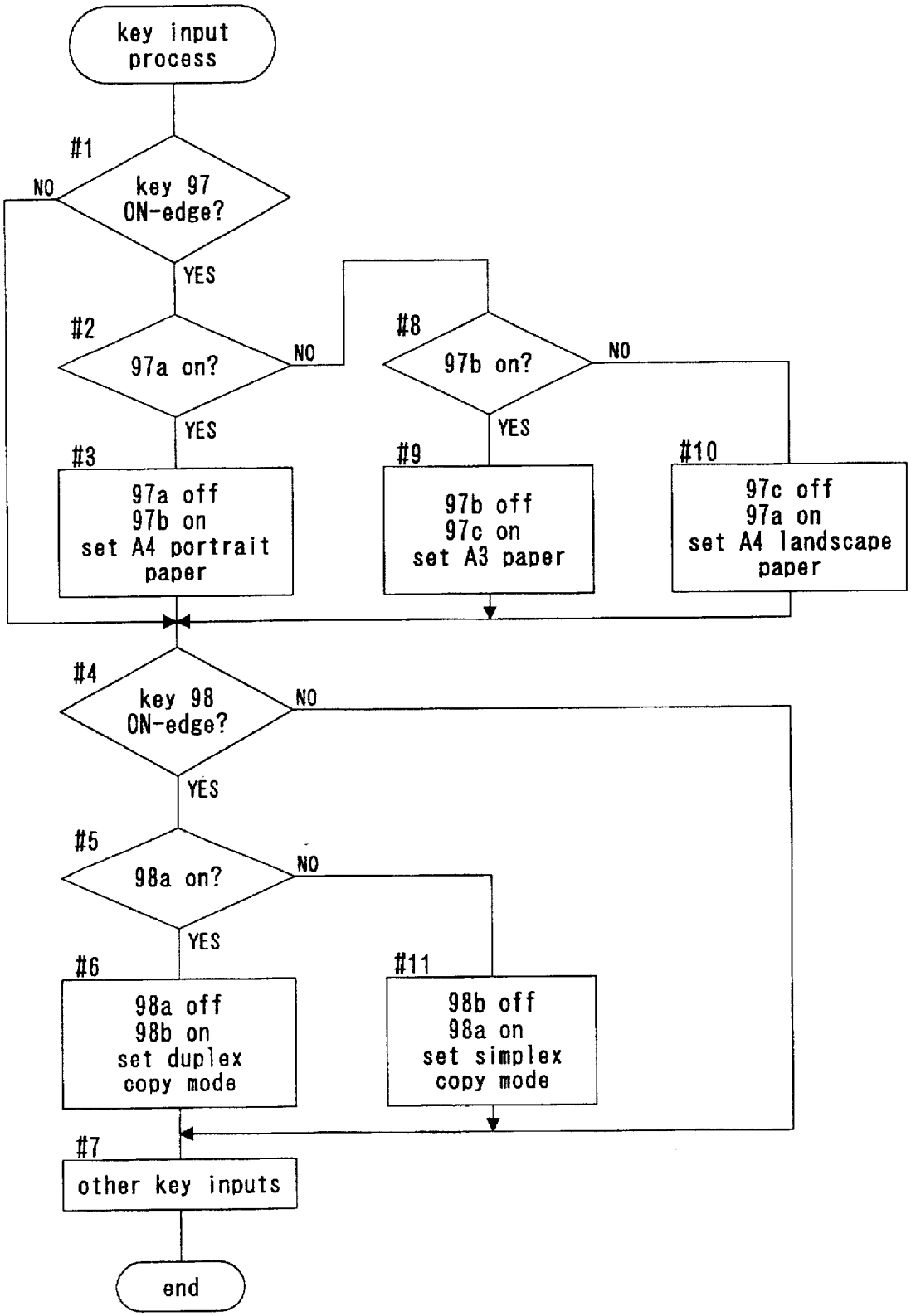
FIG. 6 is a flow chart of the process relating to key input from the operation panel.

FIG. 6 shows processing when there is key input from the operation panel. First, in step #1, a check is made to determine whether or not the paper election key 97 is ON-edge. If key 97 is ON-edge (#1: YES), a check is made in step #2 to determine whether or not the LED 97*a* is lighted (ON). If LED 97*a* is ON (#2: YES), the A4 landscape paper selected until now is cancelled (97*a* OFF), and A4 portrait paper is selected anew (97*b* ON) in step #3. If LED 97*a* is not ON (#2: NO), a check is made in step #8 to determine whether or not LED 97*b* is ON; if LED 97*b* is ON, LED 97*b* is turned OFF and LED 97*c* is turned ON in step #9 to select A3 paper. When the reply to the query in step #8 is NO, i.e., LED 97*c* is ON, and LED 97*c* is turned OFF and LED 97*a* is turned ON in step #10 to select A4 landscape paper. When key 97 is not ON-edge in step #1, the routine advances directly to step #4. In step #4, a check is made to determine whether or not copy mode selection key 98 is ON-edge. If mode selection key 98 is ON-edge, a check is made to determine whether or not the simplex copy mode key 98*a* is ON, i.e., whether or not the one-sided copy mode is currently selected. If the simplex copy mode is ON, the simplex mode key 98*a* is turned OFF and the duplex copy mode key 98*b* is turned ON in step #6 to set the duplex copy mode. When the reply to the query in step #5 is NO, the duplex mode key 98*b* is turned OF and the simplex mode key 98*a* is turned ON in step #11 to set the simplex copy mode. In step #7, processing is executed based on other key input.

Figure 7:
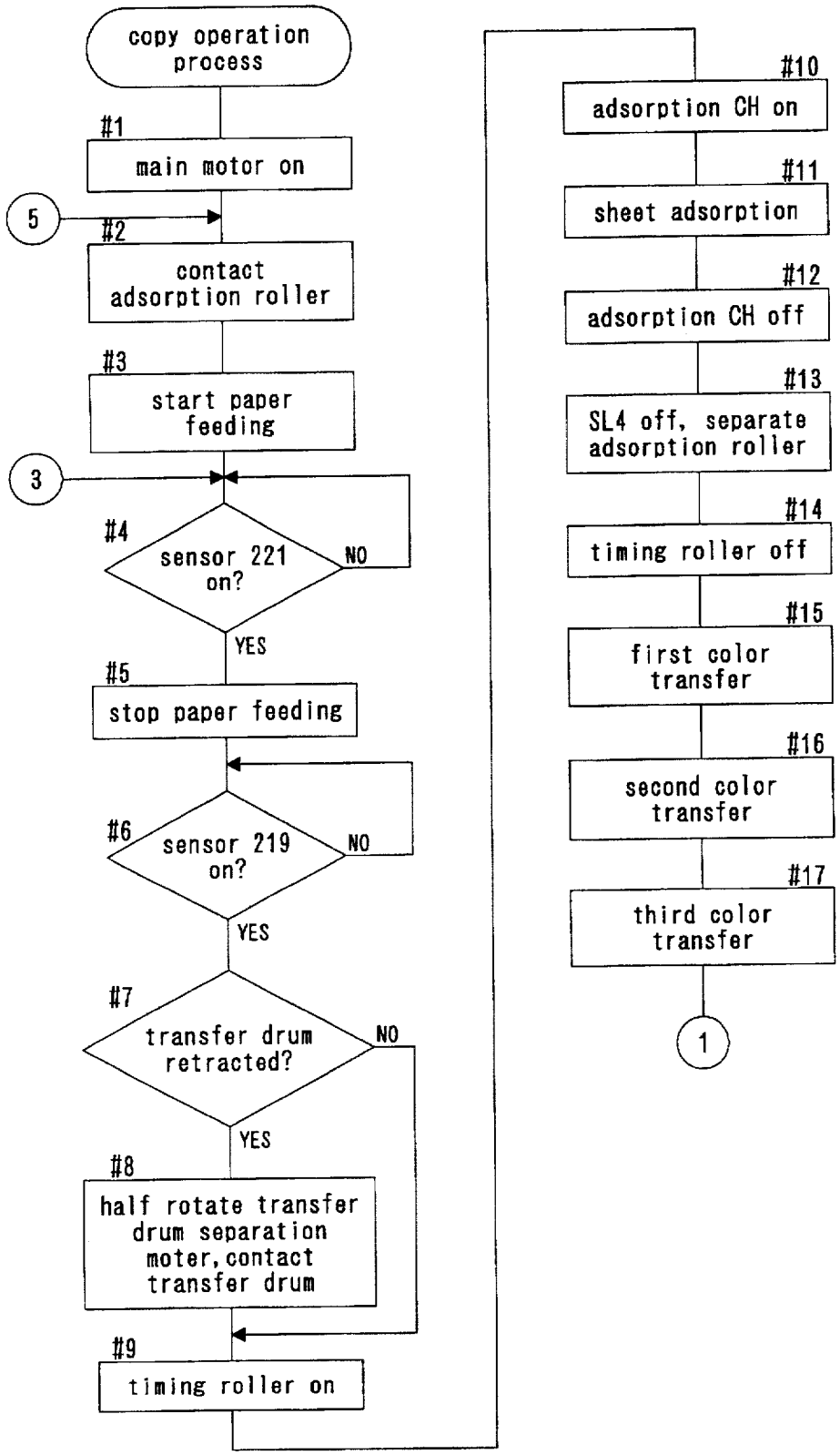
FIG. 7 is a flow chart of the process of operation control of the present invention.
Figure 8:
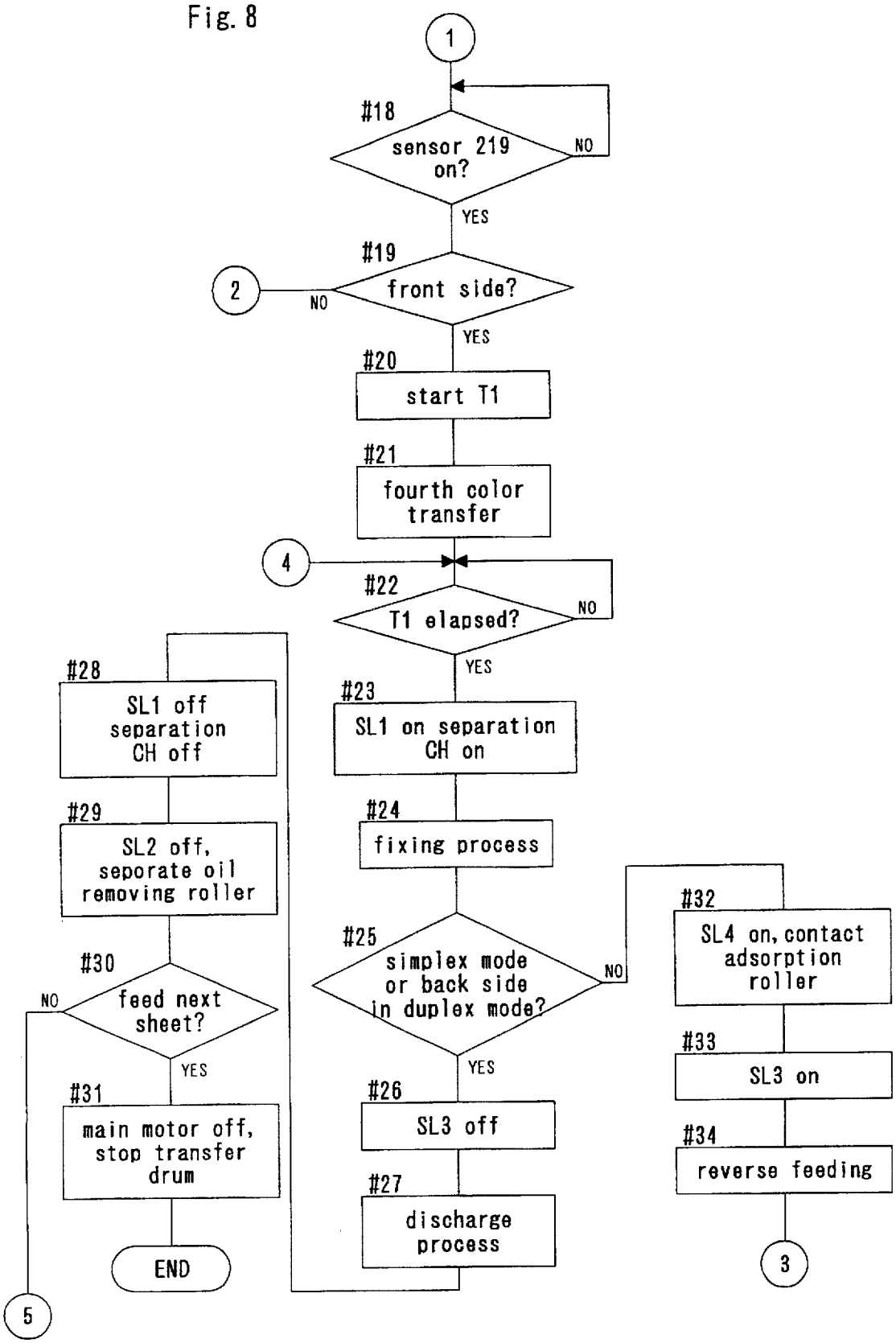
FIG. 8 is a flow chart of the process of operation control of the present invention.
Figure 9:
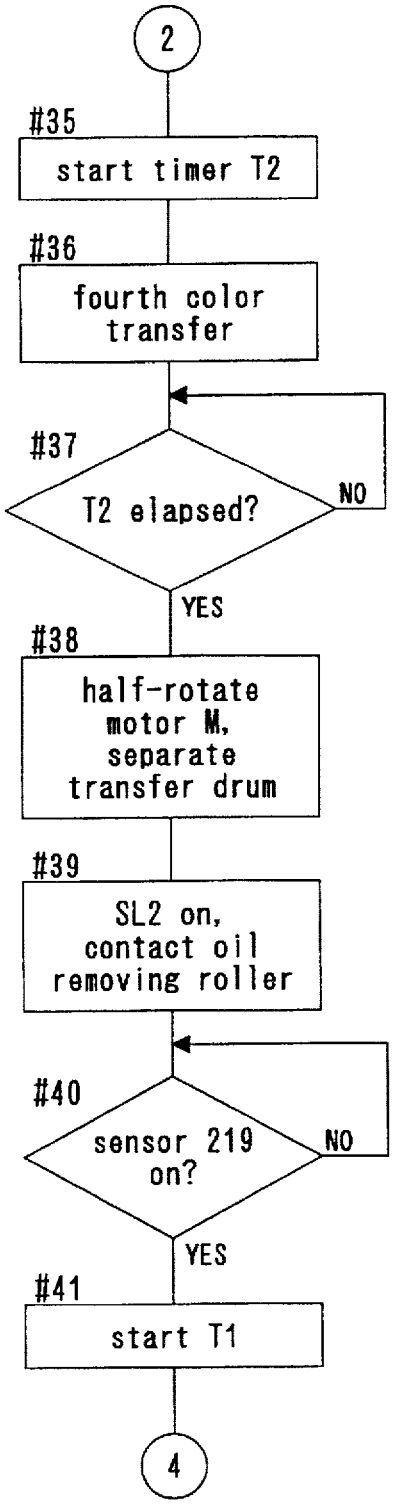
FIG. 9 is a flow chart of the process of operation control of the present invention.

FIGS. 7, 8, and 9 are flow charts showing the processes of the copy operation modes started when the copy start key is turned ON.

In step #1, the main motor is turned ON, to start actuation of transfer drum 202. Then, in step #2, solenoid SL4 is turned ON to bring adsorption roller 212 into contact with transfer drum 202. In step #3, the feed roller is turned ON to start the paper feeding operation. Then, a check is made to determine whether or not the fed sheet has been detected by the timing roller front sensor 221 (#4); if the sheet is detected, the paper feeding operation is stopped in step #5). Next, a check is made to determine whether or not sensor 219 is ON, i.e., whether or not the sheet has arrived at the paper adsorption position of transfer drum 202 (#6); if the sheet has arrived, a check is made to determine whether or not transfer drum 202 is retracted from photosensitive drum 206 in step #7. If the two drums are in a separated state, the transfer drum separation motor is half rotated in step #8 to bring transfer drum 202 into contact with photosensitive drum 206. When the drums are not separated in step #7, or when the process of step #8 is completed and transfer drum 202 is in contact with photosensitive drum 206, the timing roller is turned ON in step #9, the adsorption charger is turned ON in step #10, and the copy sheet is adhered to transfer drum in step #11. Thereafter, the adsorption charger 212 is turned OFF in step #12, solenoid SL4 is turned OFF and adsorption charger 212 is separated from transfer drum 202 in step #13, and timing roller 203 is turned OFF in step #14. Then, in steps #15 through #17, the first color image, second color image, and third color image are formed and transferred onto the copy sheet. After the transfer is completed for the third color image in step #17, a check is made in step #18 to determine whether or not sensor 219 is ON, i.e., whether or not the leading edge of the copy sheet adhered to transfer drum 202 has been detected at the reference position. If the leading edge of the sheet has been detected, a check is made to determine whether or not the transfers are for the front side of the adhered copy sheet in step #19, and if it is the front side of the sheet, the timer T1 is started in step #20. Timer T1 is set at a value resulting from dividing the distance from the reference position to the sheet separation position by the system speed, and is the time required for the sheet to travel from the reference position to the sheet separation position.

$$T1=L1/V$$

(Where L1 is the distance from the reference position to the sheet separation position, and V is the system speed.)

Then, in step #21, the fourth color transfer is accomplished, and in step #22 the elapse of timer T1 is awaited. When timer T1 has elapsed in step #22, in step #23 the lifting member solenoid SL1 is turned ON, lifting member 223 is lifted, and separation chargers 209*a* and 209*b* are turned ON to accomplish the separation operation. Thereafter, the fixing process is executed in step #24. In step #25 a check is made to determine whether or not the currently set copy mode is the simplex mode, or if the duplex mode is set whether or not the fixing of the back side of the sheet has been completed. In either case, in step #26 solenoid SL3 is turned OFF, and switching finger 222 is set at position A in FIG. 1, and the discharge process is executed in step #26. In step #28, solenoid SL1 is turned OFF and separation chargers 209*a* and 209*b* are turned OFF. In step #29, solenoid SL2 is turned OFF, and oil removing roller 224 is separated from the drum. In step #30, a check is made to determine whether or not a next sheet is fed; if a next sheet is not fed, in step #31 the main motor is turned OFF and transfer drum 202 actuation is turned OFF, and the copy operation ends. If the is a fed sheet in step #30, the routine returns to step #2 in preparation for the next image formation.

On the other hand, if the currently set copy mode is not the simplex mode or if the fixing of the front side of the sheet has been completed in the duplex mode in step #25, solenoid SL4 is turned ON in step #32 and adsorption charger 212 is made to contact with transfer drum 202. Then, solenoid SL 3 is turned on in step #33 to set switching finger 222 at position B in FIG. 1, and the sheet completed fixing is inverted and fed to transfer drum 202 in step #34.

While, when it is determined that the transfer pertains to the back side of the copy sheet in step #19, a timer T2 is started in step #35. Timer T2 is set at a value resulting from dividing the value of the sum of the distance L2 from the reference position to the transfer position and the length S of the sheet in the transport direction by the system speed, and is the time required from the detection of the leading edge of the sheet until the leading edge of the sheet is removed from the transfer position.

$$T2=(L2+S)/V$$

In step #36 a fourth color is transferred, in step #37 a check is made to determine whether or not timer T2 has elapsed. If timer T2 has elapsed, in step #38 the transfer drum separation motor M is half-rotated to separate transfer drum 202 from photosensitive drum 206. Thus, the oil from the copy sheet adhered on transfer drum 202 can be prevented from adhering to photosensitive drum 206. In step #39, solenoid SL2 is turned ON, and oil removing roller 224 comes into contact with transfer roller 202 so as to remove the oil adhering to transfer drum 202 while said transfer drum 202 is in a separated state from photosensitive drum 206. Then, in step #40, a check is made to determine whether or not sensor 219 is ON; if sensor 219 is ON, the aforesaid timer T2 is started in step #41, and the routine returns to step #22. As shown in steps #35 though #41 and steps #22 and #23, even when the fourth color transfer has ended, the transfer drum 202 is rotated once without separation even when the leading edge of the copy sheet reaches the separation position, then the separation operation is accomplished when the leading edge of the sheet next reaches the separation position, thereby effectively preventing paper jams, damage to the copy sheet, and inadequate separation of the copy sheet because the transfer drum 202 is retracted during the separation operation.

Figure 10:
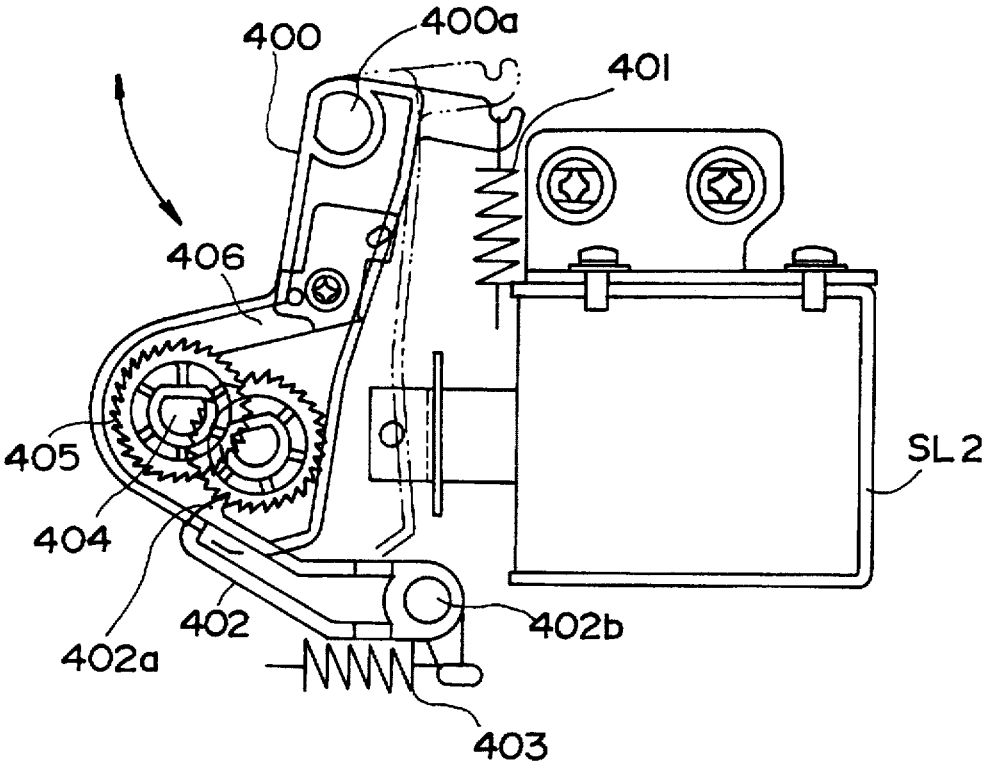
FIG. 10 briefly shows the construction of the contact/separation mechanism of the oil elimination roller.

FIG. 10 shows the contact/separation mechanism of oil removing roller 224.

In FIG. 10, the bilateral ends of oil removing roller 224 are supported on a holder 400. Holder 400 is oscillatable about a shaft 400*a*, and is forced in a counterclockwise direction by a tension spring 401 when solenoid SL2 is turned OFF. Holder 400 has a flat spring 406 mounted thereon, which engages a ratchet 405 provided on the same shaft as support shaft 404 of oil removing roller 224 and, thus, the oil removing roller 224 is prevented from being driven in rotation by the rotation of transfer drum 202. Ratchet 405 engages the finger 402*a* of lever 402, Lever 402 is forced in a clockwise direction by spring 403, so as to somewhat rotate ratchet 405 in a clockwise direction via the engagement action of ratchet 405 and the finger 402*a* when solenoid SL2 is operated, thereby preventing wear on the roller due to contact between the same surfaces of oil removing roller 204 and transfer drum 202 which are normally in contact.

Although the present invention has been described in terms of adhering one copy sheet n a transfer drum, it is to be understood to be suitable for instances wherein a plurality of copy sheets are adhered and separated on a transfer drum.

According to the present invention as described above, the transfer sheet supporting member is retracted from the image-bearing member after and image is transferred to a transfer member, such that oil adhered to the transfer sheet supporting member from the transfer member is not adhered to the image-bearing member, thereby preventing inadequate cleaning and production of irregular images. Furthermore, paper jams caused by poor separation are prevented by starting the separation operation of the transfer member from the transfer sheet supporting member after the retraction operation.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. An image forming apparatus comprising:

an image bearing member a transfer sheet supporting member which supports a transfer sheet thereon so as to transfer an image to a surface of the transfer sheet by driving the transfer sheet supporting member in contact with the image bearing member;

separating means for separating the transfer sheet from the transfer sheet supporting member;

a fixing device for fixing an image formed on the transfer sheet separated from the transfer sheet supporting member;

a supply member for supplying a separation agent to the fixing device;

inverting means for inverting and retransporting the transfer sheet fixed toner image thereon to said transfer sheet supporting member;

a mechanism for making said image bearing member and said transfer sheet supporting member contact with or separate from each other; and control means for controlling said mechanism to separate the transfer sheet supporting member from the image bearing member after an image has been transferred onto a rear surface of the transfer paper retransported by said inverting means.

2. The image forming apparatus as claimed in claim 1, wherein said control means controls said separating means to separate the transfer sheet from the transfer sheet supporting member after the transfer sheet supporting member is separated from the image bearing member.

3. The image forming apparatus as claimed in claim 2, wherein said control means controls said separating means to separate the transfer sheet from the transfer sheet supporting member after the transfer sheet supporting member separated from the image bearing member is rotated at least once.

4. The image forming apparatus as claimed in claim 1 further comprising a removing member for removing separation agent from the transfer sheet supporting member.

5. The image forming apparatus as claimed in claim 4, wherein said removing member is operated when the transfer sheet supporting member is separated from the image bearing member by said control means.

6. An image forming apparatus comprising:

an image bearing member a transfer sheet supporting member which supports a transfer sheet thereon so as to transfer an image to a surface of the transfer sheet by driving the transfer sheet sporting member in contact with the image bearing member;

separating means for separating the transfer sheet from the transfer sheet supporting member;

a fixing device for fixing an image formed on the transfer sheet separated from the transfer sheet supporting member;

a supply member for supplying a separation agent to the fixing device;

retransporting means for retransporting the transfer sheet fixed toner image thereon to said transfer sheet supporting member;

a mechanism for making said image bearing member and said transfer sheet supporting member contact with or separate from each other;

a removing member for removing separation agent adhered to the transfer sheet supporting member; and control means for controlling said mechanism to separate the transfer paper supporting member from the image bearing member after an image has been transferred onto the transfer paper retransported by said retransporting means.

7. The image forming apparatus as claimed in claim 6, wherein said retransporting means includes inverting means for inverting the transfer sheet fixed toner image thereon before retransportation.

8. The image forming apparatus as claimed in claim 6, wherein said control means controls said separating means to separate the transfer sheet from the transfer sheet supporting member after the transfer sheet supporting member is separated from the image bearing member.

9. The image forming apparatus as claimed in claim 8, wherein said control means controls said separating means to separate the transfer sheet from the transfer sheet supporting member after the transfer sheet supporting member separated from the image bearing member is rotated at least once.

* * * * *